United States Patent [19]

Gryouda et al.

[11] Patent Number: 4,885,897

[45] Date of Patent: Dec. 12, 1989

[54] METHOD OF MAKING HERMETICALLY SEALED CONTAINER

[75] Inventors: Toshio Gryouda; Shouichi Inaba; Michio Watanabe; Kanemichi Yamaguchi, all of Yokohama, Japan

[73] Assignee: Toyo Seikan Kaisha, Limited, Tokyo, Japan

[21] Appl. No.: 255,200

[22] PCT Filed: Jan. 13, 1988

[86] PCT No.: PCT/JP88/00025

§ 371 Date: Sep. 13, 1988

§ 102(e) Date: Sep. 13, 1988

[87] PCT Pub. No.: WO88/05402

PCT Pub. Date: Jul. 28, 1988

[30] Foreign Application Priority Data

Jan. 16, 1987 [JP] Japan ..... 62-8599
Jun. 25, 1987 [JP] Japan ..... 62-158577
Aug. 28, 1987 [JP] Japan ..... 62-214746

[51] Int. Cl.[4] ..... B65B 31/02

[52] U.S. Cl. ..... 53/407; 53/432; 53/510

[58] Field of Search ..... 53/407, 400, 432, 433, 53/434, 425, 426, 477, 510, 511; 426/396

[56] References Cited

U.S. PATENT DOCUMENTS 2,620,111 12/1952 Hohl et al. ..... 53/407
2,768,487 10/1956 Day et al. ..... 53/407
4,409,252 10/1983 Buschkens et al. ..... 53/432 X
4,513,015 4/1985 Clough ..... 53/433 X
4,707,334 11/1987 Gerhard ..... 53/425 X

*Primary Examiner*—James F. Coan
*Attorney, Agent, or Firm*—Armstrong, Nikaido Marmelstein, Kubovcik & Murray

[57] ABSTRACT

A method of making a hermetically sealed container is disclosed. In the method, a water vapor (40) is blown into a container body (1) that has been placed with a product such as solid foods or the like leaving a space portion (3). Immediately thereafter or immediately after an inert gas (51) has been blown into the container body, the container body is hermetically sealed. The container has a relatively low negative internal pressure which is controllable with a small range of variation. The water vapor (40) is generated by blowing a non-condensable gas such as air, nitrogen gas or the like at a constant flow rate into a water (13) which is controlled to a constant temperature. When the inert gas (51) is blown, only the surface and its vicinity of the product (4) is heated by blowing the water vapor (40). For the container body having a wall portion (1*a*) that is elastically deformable concavely depending on the negative internal pressure, the negative internal pressure can be detected by measuring the amount of the concave deformation in the wall portion (1*a*) on the same line as that for the sealing.

6 Claims, 2 Drawing Sheets

METHOD OF MAKING HERMETICALLY SEALED CONTAINER

TECHNICAL FIELD

The present invention relates to a method of making a hermetically sealed container, wherein a container body which has been placed with a product such as foods or the like is blown with water vapor thereinto, and then the container body is hermetically sealed with a lid.

BACKGROUND ART

A product such as foods or the like which has been placed in a hermetically sealed container with a space portion and contains protein, saccharide and starch generates carbon dioxide by Strecker degradation. Strecker degradation is an oxidative decarbonizing reaction of protein, saccharide and the like which occurs during retort sterilization and during storage, so that unlike putrefaction due to bacteria or the like, it creates no sanitary problem.

Since the internal pressure of the container is increased with Strecker degradation, in case of a container having a wall portion susceptible to bulging with the enhanced internal pressure, the wall portion swells out and the container is apt to be misconceived as a so-called "swelled container". Since, also when a food in a hermetically sealed container putrefies, the container swells out with generated gases, generally the food in the "swelled container" is presumed to have putrefied.

To avoid this misconception, it is desirable that the internal pressure in the hermetically sealed container prior to the retort sterilization is set to a negative pressure, that is, a pressure lower than the atmospheric pressure, of the degree that there is no danger of being misconceived as the "swelled container", even though Strecker degradation has been generated.

Conventionally, the following methods have been adopted as means for setting the internal pressure in the hermetically sealed container to a negative pressure with the main purpose of removing oxygen harmful to the long-term preservation of food products from the space portion: (a) a method of filling or placing the product and hermetically sealing both in vacuum, (b) a method wherein a stream generated from a boiler is directly blown through a nozzle into a container body placed with the product to substitute the steam for the air in the space portion, and then the container body is hermetically sealed, and (c) a so-called "hot pack method" wherein, immediately after a liquid product, such as juices or the like, heated to about 80° to 90° C. has been placed in the container body, the container body is hermetically sealed.

However, the vacuum method (a) has problems that the apparatus is complicated, the installation cost is relatively high, and the operation efficiency is too low for a high speed production.

In the steam method (b), the controls of the amount and pressure of the blown steam are difficult. Particularly, in case where the steam method is adopted to a container called a semi-rigid container in the description which will be explained hereafter, a very narrowly holed nozzle must be used because the required negative pressure is low (for example, approximately −4 cmHg in gage pressure), so that the nozzle is apt to be clogged with water droplets and foreign matters such as scales and the like in the piping, resulting in a large variation of the negative pressure therein.

Thus, there arise the problems that the container may be misconceived as the so-called "swelled container" due to an insufficient negative pressure, or be subjected to a distinguished concave deformation and the like due to an excessive negative pressure, and lose its commodity value.

In the description the following type of container which can hold its own shape under no-load condition will be called a semi-rigid container, wherein a concavity generated in a wall portion such as a bottom wall portion due to a relatively low negative internal pressure (for example, −7 cmHg in gage pressure) will be of the degree that its commodity value will not be lost, but a wall portion such as a sidewall portion will be concavely deformed or collapse to the degree that its commodity value will be lost, due to a relatively high negative internal pressure (for example, −20 cmHg in gage pressure).

A container body used for the semi-rigid container will be called a semi-rigid container body in the description.

The "hot pack method" (c) can be applied only to liquid food products, and not to solid food products such as sausages or the like. Even for liquid food products, when applied to the semi-rigid container, there arises the problem that the concave deformation of the container accompanied by cooling after hermetic sealing may increase to the degree that its commodity value will be lost.

It is an object of the present invention to provide a method of making a hermetically sealed container placed with a product, which method is practicable by using a relatively inexpensive apparatus with a high productivity, applicable even to solid food products, and capable of controlling the negative internal pressure to a relatively small value and moreover with a small range of variation.

It is another object of the present invention to provide a method of making a hermetically sealed container, wherein oxygen in a space portion is reduced to a trace quantity.

It is still another object of the present invention to provide a method of making a hermetically sealed container which is placed with a product like foods or the like and has a wall portion that is elastically deformable concavely depending on a negative internal pressure, whose hermetic sealing performance has been confirmed, and whose negative internal pressure has been detected to be of the degree that the container has no danger of being misconceived as the "swelled container", even though Strecker degradation has generated, by using a relatively inexpensive apparatus with a high productivity.

DISCLOSURE OF THE INVENTION

In a first method of making a hermetically sealed container according to the present invention, a water vapor is blown into a container body placed with a product leaving a space portion and, immediately thereafter, the container body is hermetically sealed with a lid. The water vapor is generated by blowing a non-condensable gas with a constant flow rate into a water controlled to a constant temperature.

It is preferable that the water vapor is blown into the container body such that the water vapor generated in a head space of a closed water tank by blowing the non-condensable gas with a constant flow rate into the water in the tank controlled to the constant temperature is blown from the opening end of a conduit tube communicating with the head space, against the product in the container body which product is adjacent to the opening end.

The non-condensable gas herein means the one which is not condensed under the pressure of 1 atm and at 0° C., such as air, nitrogen gas, oxygen gas, helium gas, argon gas, and carbon dioxide gas or the like. Steam and the vapors of alcohols or the like are not included in the non-condensable gas.

The temperature of the product just before blowing the water vapor is preferably lower than that of the water vapor, and more preferably around the room temperature, for example, approximately 0° to 45° C.

Since the amount of the water vapor blown into the container body is principally determined only by the water temperature, the flow rate of the non-condensable gas and a blowing time, and the use of a narrowly holed nozzle is unnecessary, it is easy to control the amount of the water vapor with a small range of variation.

After the water vapor has been blown into the container body and, immediately thereafter, the container body has been hermetically sealed with a lid, the water vapor will be condensed on the surface of the product and the inner surfaces of the container body and the lid, so that the inside of the hermetically sealed container will take a negative pressure on the way the inside of the hermetically sealed container is cooled down to the room temperature.

Consequently, the relatively flexible wall portion of the hermetically sealed hermetically, usually a bottom wall portion and/or the lid is a little recessed to reduce the content volume thereof, so that the internal pressure of the container will balance with the external pressure, that is, the open atmospheric pressure.

In this case, since the water vapor blown into the container body can be controlled to a relatively small quantity, there will not be generated so a high negative pressure as introducing such a deep concave deformation or a collapse by which the hermetically sealed container will lose its commodity value. Further, since the range of variation in the amount of the water vapor blown into the container body is small, the variation range of the negative internal pressure in the hermetically sealed container will be also small.

Since the above-described concavity in the wall portion indicates the generation of the negative pressure in the container, namely, the absence of a through-hole between the outside and the inside of the container, a hermetic sealing performance can be confirmed by the pressure of the concavity.

Further, the amount of carbon dioxide, even if generated in the hermetically sealed container by Strecker degradation, generally is relatively small. Accordingly, usually while the wall portion tries to be restored to the original flat condition, only the amount of the concavity will be reduced, and there will be no danger that the wall portion projects beyond the flat condition, that is, the "swelled container" is formed.

When the water vapor is blown from the open end of the conduit tube, since the inner diameter of the open end may be relatively large (for example, the inner diameter is approximately 7 to 10 mm is preferred), the open end will not be clogged and the amount of the blown water vapor will not be reduced.

Since the blowing of the water vapor can be effected in the open atmosphere, operation efficiency is high, and continuous production by a flow system can be performed, so that high productivity will be attained.

The water vapor generator is relatively inexpensive because it can essentially consist of a water tank, a constant temperature controller for water in the water tank, a constant flow rate non-condensable gas blowing apparatus. Further, products in a suitable form, such as a viscous form, solid form or the like can be applied.

A non-condensable inert gas can be used in the above-described making method according to the present invention. As the non-condensable inert gases, nitrogen gas, helium gas, argon gas and the like are exemplified.

In this case, when the mixed gas of water vapor and non-condensable inert gas is blown into the container body, since the air in the space portion is replaced by the mixed gas containing no oxygen gas, oxygen in the space portion of the sealed container will be reduced to a trace quantity.

In another (second) method of making the hermetically sealed container according to the present invention, additional steps wherein only the surface and its vicinity of the product is heated by flowing the water vapor, and then the inert gas is blown to substitute the inert gas for the water vapor and residual air in the space portion are provided between the step wherein the water vapor is blown into the container body and the step wherein the container body is hermetically sealed with the lid, both in the first method.

While the surface temperature of the product is usually lower than that of the water vapor blown into the container body, in this case, only the surface and its vicinity of the product blown with the water vapor for a short time is heated and, at this time, the latent heat of the water vapor is taken away, resulting in condensation of moisture on the surface.

Since the resultant condensed water is evaporated into water vapor even in a short time from the termination of the blowing of the inert gas to the hermetic sealing, it results that some quantity of the water vapor is present in the space portion just after the hermetic sealing.

The amount of the water vapor in the container after sealing can be controlled within a small range of variation by the temperature and the amount of the water vapor blown into the container body, the surface temperature of the product, the temperature of the inert gas blown against the product, the time from the inert gas blowing to the hermetic sealing, and the like.

While the inside of the sealed container is cooled down to the room temperature, the water vapor will be condensed and the inside of the container will take a negative pressure. Consequently, in the same way as described above, the "swelled container" will not be formed nor such a large concave deformation that will lose the commodity value will be produced. Further, also the hermetic sealing performance can be confirmed.

In this case, since only the surface and its vicinity of the product may be heated, the operation time can be short, resulting in a high productivity, and the quality deterioration of the product due to the thermal hysteresis during the operation will be hardly generated.

Even when the non-condensable gas is oxygen gas or a gas containing the relatively large amount of oxygen like air, oxygen in the space portion can be reduced to a trace quantity. Also, when the non-condensable gas in an inert gas, oxygen in the space portion can be reduced to a trace quantity as compared when the case when the gas in the space portion is not substituted by the inert gas.

In still another (third) method of making the hermetically sealed container according to the invention, a step wherein a water vapor generated by blowing the non-condensable gas with a constant flow rate into a water controlled to a constant temperature is blown into the container body that is placed with a product leaving a space portion and has a wall portion which is elastically deformable concavely depending on the negative internal pressure, a step wherein the container body is sealed with the lid, and a step wherein the amount of the concave deformation of the wall portion is measured, are conducted on one line.

The wall portion which is elastically deformable concavely depending on the negative internal pressure means the one which represents such a reproducibility that, in a range wherein the negative internal pressure is relatively low, the higher the negative internal pressure is, the larger the concave deformation amount is and, when the negative internal pressure returns to zero, also the concave deformation amount substantially returns to zero, whereby the negative internal pressure can be determined from the amount of the concave deformation. The bottom wall portion or the like of the semi-rigid container body falls thereunder.

Since the container body has the wall portion that is elastically deformable concavely depending on the negative internal pressure and, after sealing, the concave deformation amount of the wall portion is measured on the same line, the negative internal pressure can be evaluated soon after the sealing.

Accordingly, even if manufacture should be conducted without being aware of an accident or the like in the water vapor generator, the manufacture of the hermetically sealed container having the negative internal pressure within a prescribed range can be resumed by detecting that the negative internal pressure exceeds the prescribed range and thereby finding and restoring the accident.

Further, the defective container that has a pin hole or the like which penetrates the lid or a sealed portion and, therefore, has no sealing performance, can be detected as having a zero negative internal pressure. The container that has been callapsed by the excessive negative internal pressure is detected as having an excessive negative internal pressure. By rejecting those containers whose negative internal pressure is outside the prescribed range from the line, only the hermetically sealed containers whose negative inner pressure is within the prescribed range and whose sealing performance is confirmed are fed out from the line.

Since the water vapor may be blown in the open atmosphere, the operation efficiency is high and, since all the steps are executed on the same line, the productivity is high due to the continuous production by a flow system.

BEST MODE FOR CARRYING OUT THE INVENTION

The present invention will now be described with reference to the accompanying drawings.

Figure 1:
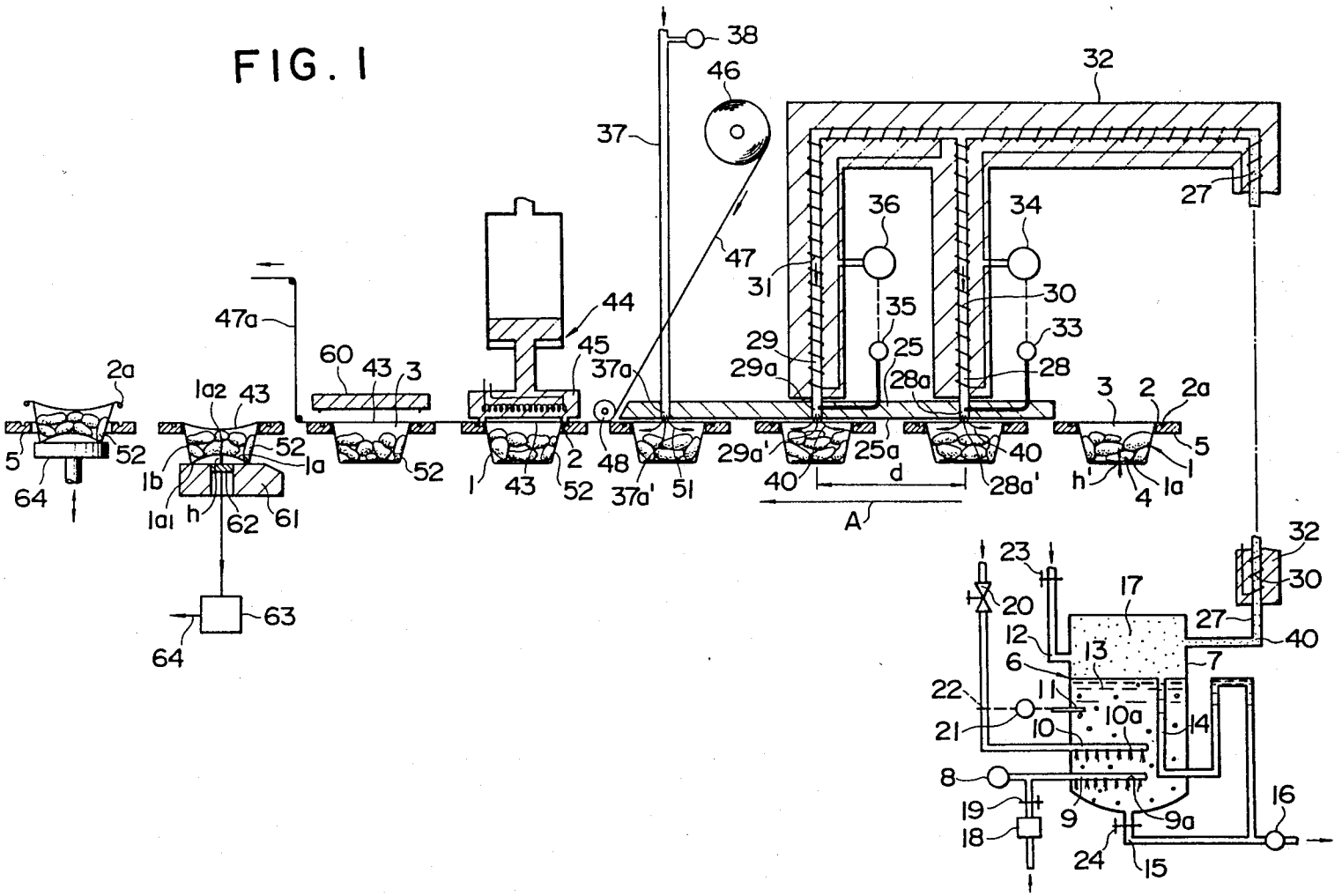
FIG. 1 is the explanatory longitudinal section of an example of an apparatus for carrying out a method according to the present invention.

In FIG. 1, a reference numeral 1 designates a cup-shaped semi-rigid container body that has been formed by drawing a laminate blank having thermoplastic films, for example, polypropylene films as inner and outer layers and a metallic foil as a middle layer and formed with an enforcing curling portion 2*a* on the periphery of a flange 2.

The container body 1 is placed with a product 4 of about the room temperature, that is, usually of approximately 0° to 45° C. and preferably of approximately 5° to 40° C., leaving a space portion 3. The product is usually one of foods.

The respective container bodies 1 are supported by holders 5 at the flanges 2 with a prescribed center distance of d, and carried in the direction shown by an arrow A intermittently at a prescribed timing, for example, stopping for two seconds and moving for one second.

A reference numeral 6 designates a water vapor generator which is provided with a water tank 7, an air blowing pipe 9 having a flowmeter 8, a steam blowing pipe 10 and a thermometer 11. A reference numeral 12 denotes a water pipe for supplying the water tank 7 with a water 13 prior to starting an operation, 14 a drain pipe for holding a water level constant and forming a head space 17 with a prescribed volume, 15 a pipe for draining water after the operation, and 16 a steam trap.

Air with a constant flow rate, for example, of 5 l/min. is fed from an air source not shown under an air pressure approximately 1.5 kg/cm$^2$ to the air blowing pipe 9 via a filter 18 and a manually operated flow rate regulating valve 19, and blown out through ports 9*a*.

Steam, for example, under 0.7 kg/cm$^2$ and at 115° C. is fed from a boiler not shown to the steam blowing pipe 10 via a reducing valve 20 and a valve 22 that is opened and closed at signals from a temperature controller 21, and blown out through ports 10*a*. Reference numerals 23 and 24 designate manually operated valves. The temperature of the water 13 in the water tank 7 is held at a prescribed value, for example, 91±0.5° C. by the steam.

A water vapor pipe 27 which is preferably made of a stainless steel is connected to the head space 17 of the water tank 7. The flow rate of the water vapor 40 fed out through the water vapor pipe 27 is controlled by the temperature of the water in the water tank 7 and the flow rate of the air blown from the air flowing pipe 9.

The water vapor pipe 27 branches out into two vertical water vapor branch pipes 28 and 29 with a center distance of a d therebetween downstream the water vapor pipe 27. The water vapor pipe 27, the water vapor branch pipes 28 and 29 are wound by heater coils 30 and 31 and covered by a thermal insulator 32. Water vapor temperature at the open ends 28*a*′ and 29*a*′ of the water vapor branches 28 and 29 are controlled by a thermometer 33, a controller 34 and a thermometer 35, a controller 36, respectively, to a prescribed temperature, preferably to 101° to 110° C., for example, 105° C.

A vertical blowing pipe 37 for an inert gas is arranged downstream the water vapor branch 29 with a distance of d therebetween. A reference numeral 38 denotes a flowmeter. Nitrogen gas is preferably used as the inert gas, and carbon dioxide or the other inert gases may be available. The inert gas, usually at the room temperature, is blown out from the open end 37*a'* of the inert gas blowing pipe 37.

The lower end portions 28*a*, 29*a* and 37*a* of the water vapor branches 28, 29 and the inert gas blowing pipe 37, respectively, are formed with vertical holes provided in a support plate 25 having a flat bottom surface 25*a*. The open ends 28*a'* and 29*a'* of the branches 28*a* and 29*a*, respectively, have usually inner diameters of 4 to 10 mm.

The support plate 25 is provided with a heater not shown, for example, a steam pipe or an electric resistance heater, and the temperature in the neighborhood of the bottom surface 25*a* of the plate 25 is kept preferably at approximately 105° C., for preventing the bottom surface 25*a* from dew condensation.

A heater sealer 44 for the lid 43 is arranged downstream, and at a center distance of d apart from the inert gas blowing pipe 37.

A reference numeral 45 designates a hot plate for heat sealing. The lid 43 is formed from the portion of a strip film or web 47 unwound from a laminate coil 46 that has been placed on the flange 2 of the container body 1 via a guide roll 48.

A laminate having thermoplastic films as inner and outer layers, for example, a polyethylene terephthalate film and a polypropylene film as the outer and the inner layers, respectively, and having a metallic foil as a middle layer is used for the coil 46.

The container body 1 is blown with the water vapor containing some air thereinto, while it stops and passes below the water vapor branches 28 and 29. This replaces most of the air in the space portion 3 with the water vapor which heats the product 4 preferably to 50° C. or above. Since a total blowing time is very short, for example, approximately four seconds, only the surface and its vicinity of the product 4 (for example, a 0 to 1 mm deep portion as measured from the surface) is heated. At this time, moisture is condensed on the surface of the product 4.

Immediately thereafter, the container body 1 is carried to the underneath of the inert gas blowing pipe 37 and stopped. The inert gas 51 is blown into the container body 1, and the water vapor and remaining air in the space portion 3 is replaced by the inert gas 51. The blown inert gas may be at a temperature higher than the room temperature, for example, approximately 60° to 150° C. When the inert gas is nitrogen, since its heat capacity is extremely small, the product 4 is scarcely heated by the blowing of the inert gas described above.

Then, the container body 1 is carried to the underneath of the heat sealer 44, stopped and heat sealed to the flange 2 with the lid 43 to form a hermetically sealed container 52. In the subsequent step, the lid 43 is cut off from the web 47 by means of a cutter 60. A web portion 47*a* wherein the lid 43 has been cut off from the web 47 is wound by a winding machine not shown to become scrap.

While most of the water vapor in the space portion 3 is removed by above-described inert gas replacement, the relatively high temperature moisture condensed on the heated surface of the product 4 is evaporated to form water vapor (at this time, the product surface is deprived of latent heat and cooled) for a short time until the container body 1 is moved to the underneath of the heat sealer 44, and the atmosphere of the space portion 3 becomes composed of the water vapor and the inert gas, with a relatively low partial pressure, for example, 5 to 10 cmHg of the water vapor.

Accordingly, the negative pressure generated in the space portion 3 by the recondensation of the water vapor onto the cooled surface of the product accompanying the cooling of the sealed container 52, and the inner wall surface of the container is low.

As a result, the relatively flexible lid 43 and the bottom wall portion 1*a* of the container body 1 are slightly recessed as shown after a short time, usually after 20 to 30 seconds after the sealing, but no substantial deformation is observed on the sidewall portion 1*b*.

In the subsequent step, after having slided on a slide 61 equipped with an eddy current type distance sensor 62, the sealed container 52 stops and is measured with the maximum recess depth h of the bottom wall portion 1*a*, wherein the recess depth means a level difference between the annular peripheral projection $1a_1$ of the bottom wall portion 1*a* and a central portion $1a_2$, and the recess is based on an elastic deformation.

The output signal of the sensor 62 is inputted to a comparator 63 and, when the depth h is smaller than $h_1$, that is, when the negative inner pressure is insufficient, or when the depth h is larger than $h_2$ ($h_2 > h_1$), that is, when the negative inner pressure is so excessive as to create collapse, the comparator 63 outputs a reject signal 64.

The values of $h_1$ and $h_2$ are determined, for example, as follows; in case where a concavity depth h' in the middle of the bottom wall portion prior to the sealing (see the container body 1 at the most right side in FIG. 1) is 0.3±0.05 mm, and when the concavity depth h exceeds 1.3 mm, at which depth the sealed container 52 will be collapsed due to an excessive negative internal pressure, the values of $h_1$ and $h_2$ are determined to be 0.5 mm and 1.1 mm, respectively.

In the subsequent step, the sealed container 52 is pushed by a lifter 64 and fed out off the holder 5. At this time, the normal container 52 having a relationship $h_1 \leqq h \leqq h_2$, namely, the hermetically sealed container is pushed out onto a first conveyor not shown on the forward side of the drawing by a pusher not shown, and the defective container 52 having a relationship $h < h_1$ or $h > h_2$ is pushed out onto a second conveyor not shown on the rearward side of the drawing at the reject signal 64. The recess depth h may be measured also by a magnetic sensor, an optical sensor, a mechanical sensor or the like.

Instead of air, a non-condensable gas, such as nitrogen gas, may be blown into the water tank 7 through the blowing pipe 9. In case where oxygen gas may remain in the space portion of the hermetically sealed container depending on the kind or the like of the product 4, for example, in case of a food product, such as noodles or boiled rice, which is hardly deteriorated by oxygen, or a food product, wherein the adverse effect of oxygen is decreased by the addition of an antioxidant such as ascorbic acid, blowing the inert gas 51 into the container body is not always necessary. In this case, an apparatus provided with the heat sealer 44 at the position of the inert gas blowing pipe 37 is used.

Heat sealing may be performed twice by arranging one more hot plate 45. Further, a step for cooling the heat sealed portion may be provided between the final heat sealing step and the lid cutting step.

Figure 2:
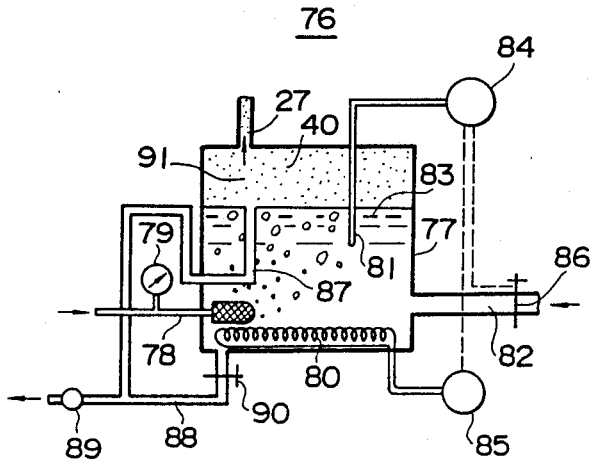
FIG. 2 is the explanatory longitudinal section of an example of a water vapor generator to be used for carrying out a method according to the present invention, and of a different type from that shown in FIG. 1.

The water vapor generator may be of a type designated by a numeral 76 in FIG. 2. The water vapor generator 76 is provided with a water tank 77, an air, namely, a non-condensable gas blowing nozzle 78 having a flowmeter 79, a heater 80 and a thermometer 81. The water tank 77 is provided with a steam blowing pipe 82 for feeding and heating the water 83 in the water tank 77.

The temperature of the water 83 in the water tank 77 is kept within a prescribed temperature range, for example, at 91±0.5° C. by the voltage control of a power supply 85 for the heater 80 by using a controller 84, and the opening control of a damper 86 provided in the steam blowing pipe 82.

A reference numeral 87 designates a drain pipe for holding the water level constant, 88 a drain pipe for exhausting the tank, 89 a steam trap, 90 a manually operated valve, and 91 a head space. The flow rate of water vapor 40 fed out from the water vapor generator 76 through a water vapor pipe 27 is controlled by the temperature of the water in the water tank 77 and the flow rate of air blown from a nozzle 78.

EXAMPLE 1

The temperature of the water in the water tank 7, wherein the content volume was 5000 c.c., the volume of the head space 17 was 2000 c.c., was set at 92° C. by means of a temperature controller 21 for controlling the opening and closing of the valve of the steam blowing pipe 10 (steam temperature: 115° C.), and an air whose source pressure was 1.5 kg/cm$^2$, was fed into the water tank 7 through the air blowing pipe 9 with the flow rate of 5 Nl/min, whereby water vapor 40 was generated by 12.3 gr./min.

A laminate blank having inner and outer surface layers of polypropylene films of 50 μm thick and a middle layer of a roller steel foil of 75 μm thick was drawn to form a cup-shaped semi-rigid container body 1 with the flange, having a sidewall portion of outer diameters at top and bottom of 65 mm and 56 mm, respectively, a height of 30 mm, and a content volume of 85 ml.

While the container body 1 was supported at the flange 2 with the holder 5, and transferred at intermittent displacements of twenty times per minute, that is, repeating a stopping for two seconds and a moving for one second, the container body 1 was packed with meat patties 4 of 35 gr.

While the container body 1 was transferred in the direction shown by the arrow A as shown in FIG. 1, it was stopped when reached below the water vapor branch pipes 28 and 29, and the water vapor 40 was blown thereinto from the open ends 28*a*′ and 29*a*′. The gap width between the bottom surface 25*a* of the support plate 25 and the flange 2 was 5 mm. The distance d between the central axes of the water vapor branch pipes 28 and 29 was 120 mm.

Then, immediately after a nitrogen gas of 250 ml at 20° C. had been blown from the open end 37*a*′ of the inert gas blowing pipe 37, and the lid 43 was heat sealed in the flange 2.

The lid 43 was formed from a laminate web 47 having the inner, middle and outer layers made of a polypropylene film of 50 μm thick, an aluminum foil of 20 μm thick, and a biaxially oriented polyethylene terephthalate film of 12 μm thick, respectively.

After the heat sealing, the heat sealed portion was cooled by a cooling apparatus not shown and then the lid 43 was punched off. Then, the maximum recess depth h was measured by using the eddy current type distance sensor 62. In case of this container, the negative inner pressure was −2 cmHg when the depth h was 0.5 mm, and −16 cmHg when 1.1 mm. When h<0.05 mm or h>1.1 mm, the reject signal was adapted to be outputted.

Two hundred containers 52 were made in the way as described above. It was confirmed that the recess depths h of all the containers were within the range of 0.5 to 1.1 mm, that is, their reduced internal pressures were in a proper range, and their hermetic sealing was good. It took thirty seconds from the heat sealing to the measurement of the recess depth. Accordingly, although not shown in FIG. 1, about ten holders 5 were provided between the heat sealer 44 and the distance sensor 62.

Further, twenty containers 52 were made in the same manner as above except that a pin hole of 0.2 mm diameter has been intentionally formed through the lid 43. In this case reject signals were outputted for all the containers 52, which were rejected.

Sterilization was effected at 115° C. and for forty minutes by using a shower type uniform pressure retort on hundred containers 52 out of the above containers, whose hermetic sealing had been detected to be good. After retort sterilization the hundred containers 52 maintained slight deformation due to reduced pressure, and none of those were subjected to such excessive concave deformation or the like that will damage their commodity value.

The results of analysis of the gas in the space portions of the hermetically sealed containers 52 before and after the retort sterilization were that $O_2$ was 2 and 0 volume percent in average, $N_2$ 98 and 89 volume percent in average, and $CO_2$ 0 and 11 volume percent in average, respectively.

EXAMPLE 2

The hermetically sealed containers were made by using a partial modification of the apparatus shown in FIG. 1 in the same manner as the example 1, except that the heat sealer 44 was arranged just after the water vapor branch pipe 29 is hermetically seal by heat sealing the lid 43 to the flange 2 immediately after the water vapor blowing, and nitrogen gas was fed into the water tank 7 instead of air.

Also in this case, after the retort sterilization the hermetically sealed containers maintained slight concave deformation, and none of those were subjected to such excessively concave deformation that will damage their commodity value.

The results of analysis of the gas in the space portion of the hermetically sealed container 52 before and after the retort sterilization were that $O_2$ was 9 and 0 volume percent in average, $N_2$ 91 and 87 volume percent in average, and $CO_2$ 0 and 13 volume percent in average, respectively.

INDUSTRIAL APPLICABILITY

The method of making a hermetically sealed container according to the present invention is suitable for the manufacture of a hermetically sealed semi-rigid container which is placed with especially solid foods such as cooked foods, fishes, meats and boiled rices, and fluid foods whose placing temperature is about the room temperature, and the like, to be processed by retort sterilization and stored for a long term at the room temperature.

We claim:

1. A method of making a hermetically sealed container (52) comprising the steps of:

blowing a water vapor (40) generated by blowing a non-condensable gas with a constant flow rate into a water (13) which is controlled to a constant temperature, into a container body (1) which has been placed with a produce (4) leaving a space portion (3); and immediately thereafter, hermetically sealing said container body with a lid (43).

2. A method of making a hermetically sealed container as claimed in claim 1 wherein the non-condensable gas comprises a non-condensable inert gas.

3. A method of making a hermetically sealed container (52) comprising the steps of:

blowing a water vapor (40) generated by blowing a non-condensable gas with a constant flow rate into a water (13) which is controlled to a constant temperature, into a container body (1) which has been placed with a product (4) leaving a space portion (3), thereby heating only the surface and the vicinity thereof of said product; then blowing an inert gas (51) into the container body, thereby substituting said inert gas for said water vapor and a remaining air in said space portion; and immediately thereafter, hermetically sealing said container body with a lid (43).

4. A method of making a hermetically sealed container as claimed in claim 1, 2 or 3 wherein said hermetic sealing is performed by heat sealing.

5. A method of making a hermetically sealed container characterized by the provision of a line comprising the steps of:

blowing a water vapor (40) generated by blowing a non-condensable gas with a constant flow rate into a water (13) which is controlled to a constant temperature, into a container body (1) which has been placed with a product (4) leaving a space portion (3) and has a wall portion (1*a*) that is elastically deformable concavely depending on a negative internal pressure; sealing said container body with a lid (43); and measuring a quantity of a concave deformation in said wall portion after said sealing on the same line.

6. A method of making a hermetically sealed container as claimed in claim 5 wherein said sealing is performed by heat sealing.

* * * * *

UNITED STATES PATENT AND TRADEMARK OFFICE

CERTIFICATE OF CORRECTION

PATENT NO. : 4,885,897

DATED : December 12, 1989

INVENTOR(S) : GRYOUDA et al

It is certified that error appears in the above-identified patent and that said Letters Patent is hereby corrected as shown below:

Column 1, line 47, "stream" should read --steam--.

Column 3, line 35, "hermetically sealed hermetically" should read --hermetically sealed container--.

Signed and Sealed this

Eleventh Day of December, 1990

*Attest:*

HARRY F. MANBECK, JR.

*Attesting Officer*

*Commissioner of Patents and Trademarks*